US005081366A

United States Patent [19]

Isozumi

[11] Patent Number: 5,081,366

[45] Date of Patent: Jan. 14, 1992

[54] ENGINE STARTER MOTOR

[75] Inventor: Shuzou Isozumi, Hyogo, Japan

[73] Assignee: Mitsubishi Denki Kabushiki Kaisha, Tokyo, Japan

[21] Appl. No.: 551,371

[22] Filed: Jul. 10, 1990

[30] Foreign Application Priority Data

Jul. 13, 1989 [JP] Japan ..... 1-82451[U]
Jul. 13, 1989 [JP] Japan ..... 1-82452[U]
Jul. 13, 1989 [JP] Japan ..... 1-180976[U]

[51] Int. Cl.[5] ..... F02N 11/08
[52] U.S. Cl. ..... 290/48; 74/6
[58] Field of Search ..... 74/6, 7 A, 7 R; 290/48

[56] References Cited

U.S. PATENT DOCUMENTS 4,104,926 8/1978 Wilson ..... 74/6
4,206,656 6/1980 Hollyoak ..... 74/6
4,326,429 4/1982 Mortensen ..... 74/6
4,931,663 6/1990 Morishita et al. ..... 290/48

*Primary Examiner*—A. D. Pellinen
*Assistant Examiner*—Lawrence E. Colbert
*Attorney, Agent, or Firm*—Sughrue, Mion, Zinn, Macpeak and Seas

[57] ABSTRACT

A starter motor comprises an oil seal of resilient sheet material disposed between a bearing supporting a pinion slider and a front frame portion having an opening in which the bearing is supported and in resilient contact with the slidable support surface and an annular metal holder having an angled U shape cross section and fixedly secured to the slidable support surface with a valley portion thereof facing to the bearing and an annular lip extending forwardly from a peripheral edge of the opening so that it enters into the valley portion of the holder when the pinion slider is in a rest position. At least one drain is formed in an outer wall of the front frame portion and extends along the oil seal. The oil seal of resilent material may have a generally T shape cross section with a lateral bar portion thereof being used as the oil seal and a vertical bar portion thereof being used as the annular lip. A drain hole may be formed in the vertical bar portion.

12 Claims, 3 Drawing Sheets

ENGINE STARTER MOTOR

BACKGROUND OF THE INVENTION

The present invention relates to an engine starter motor and, particularly, to an engine starter motor having a water proof structure.

An engine starter motor of the so-called overhang type is known and an example is disclosed in Japanese Kokai (Utility Model) No. 61-6679. The construction of this known engine starter motor will be described with reference to FIGS. 7 and 8.

The engine starter motor shown in FIGS. 7 and 8 has a front frame portion 1 of a frame structure. The front frame portion 1 is formed with an opening 2 through which an extension 3 of an armature shaft of a d.c. motor (not shown) provided in the frame extends forwardly. A pinion slider 4 is slidably and rotatably mounted on the extension 3 through a bearing 5. The pinion slider 4 is supported slidably and rotatably by a bearing 6 arranged inside the front frame portion and thus the extension 3 is also supported thereby.

In such starter motor structure, the pinion slider 4 has a forward end portion formed with a pinion 4*a* therearound and a rear end forming a clutch-inner 7*a* which is a constitutional component of an over-running clutch 7 having a clutch-outer 7*b* and rollers 7*c* for transmitting rotation of the clutch-outer to the clutch-inner. An intermediate portion of the pinion slider between the pinion 4*a* and the clutch inner 7*a* provides a sliding support surface 4*b* to be supported by the bearing 6.

Reference numerals 8, 9, 10 and 11 in FIGS. 7 and 8 depict an oil seal, a dust-proof cap mounted detachably on the front end portion of the pinion slider 4, a stopper mounted on the front end of the extension 3 for preventing the pinion slider 4 from dropping out and a ring gear of an engine, respectively.

An operation of this construction will be described briefly.

When the over-running clutch 7 is moved forwardly along an arrow 12 by means of a shift lever (not shown), the pinion slider 4 slides on the extension 3 integrally, so that the pinion 4*a* goes out from the opening 2 of the front frame 1 and meshes with the ring gear 11 as shown in FIG. 8.

Immediately before the pinion 4*a* meshes with the ring gear 11, power is supplied to the d.c. motor and rotation of its armature shaft is transmitted from the clutch-outer 7*b* of the over-running clutch 7 through the rollers 7*c* to the clutch-inner 7*a* and then the pinion slider 4. Thus, at the time of meshing, the engine is started through the ring gear 11.

When the pinion slider 4 is rotated by the engine at high speed after the engine is started and before the pinion slider is retracted, the clutch-inner 7*a* rotates at higher speed than the clutch-outer 7*b*. Therefore, the rollers 7*c* which serve as a one-way clutch are separated from the clutch-inner and the clutch-outer to allow the clutch-inner 7*a* to rotate freely to thereby prevent a transmission high speed rotation of the pinion slider to the engine.

The oil seal 8 is shown in FIG. 9. The oil seal 8 is constituted by a an steel ring 8*a* having an L shape cross section and a rubber ring 8*b* having a V shape cross section and fitted onto an inside of the steel ring 8*a*. The steel ring 8*a* is pressure-fitted on a shoulder portion 1*a* of the front frame portion 1 with a space with respect to the bearing 6 and a lip portion 8*c* of the rubber ring 8*b* is in resilient contact with the outer surface of the pinion slider 4 with a lower end of the rubber ring 8*b* being bent, as shown in FIG. 9.

In such a conventional structure, there is a tendency that water is caught within the bent portion of the rubber ring 8*b*. Particularly, when such starter motor is mounted on an engine with the pinion thereof being upside, the rubber ring 8*b* may receive and store water in its valley. Such water in the valley portion of the rubber ring 8*b* may easily enter into the front frame 1 due to thermal aspiration and/or vibration and may consequently cause the bearing 6 to rust, so that smooth sliding of the pinion slider 4 can not be obtained. Water that has entered into the front frame 1 may easily enter into the d.c. motor causing the latter to be damaged.

SUMMARY OF THE INVENTION

An object of the present invention is to provide a starter motor having an oil seal structure which prevents water from being caught therein regardless of mounting attitude of the starter motor on an engine.

In order to achieve the above object, according to an aspect of the present invention, a starter motor, in which a pinion slider mounted slidably on an output shaft of a d.c. motor and having one end portion formed with a pinion portion and the other end portion providing a slidable support surface to be slidably and rotatably supported by a bearing provided in a front frame portion is moved slidably through an opening formed in the front frame portion, includes 1) an oil seal of resilient sheet material disposed between the bearing and the front frame portion and in resilient contact with the slidable support surface of the pinion slider at a front end thereof, 2) a metal holder having an angled U shape cross section and fixedly secured to the slidable support surface of the pinion slider with a valley portion thereof facing toward the bearing, and 3) an annular lip extending forwardly from a peripheral edge of the opening so that it enters into the valley portion of the holder when the pinion slider is in a rest position, that is it is fully retracted.

According to another aspect of the present invention, at least one drain is formed in an outer wall of the front frame portion. The drain extends along the oil seal.

With this construction of the starter motor, when the pinion slider is in the rest position, an outer surface of the annular lip is covered by the holder and, therefore, water immigration into the front frame portion is prevented by the holder regardless of mounting attitude of the starter motor on the engine. Further, water that enters when the pinion slider is moved forwardly can be discharged through the drain.

According to another aspect of the present invention, the oil seal of resilent material has a generally T shape cross section with one end of the lateral bar of the T shape being supported between the bearing and the front frame portion, the other end of the lateral bar being in resilient contact with the slidable support surface and the vertical bar of the T shape extending along the pinion slider and entering into the holder when the pinion slider is in the rest position. At least one drain hole is formed in the vertical bar of the oil seal.

The vertical bar prevents water from entering into the front frame when the pinion slider is in the rest position. The lateral bar prevents water from entering into the front frame and the drain hole formed in the vertical bar discharges water when the pinion slider is moved forwardly.

DETAILED DESCRIPTION OF THE PREFERRED EMBODIMENTS

Figure 1:
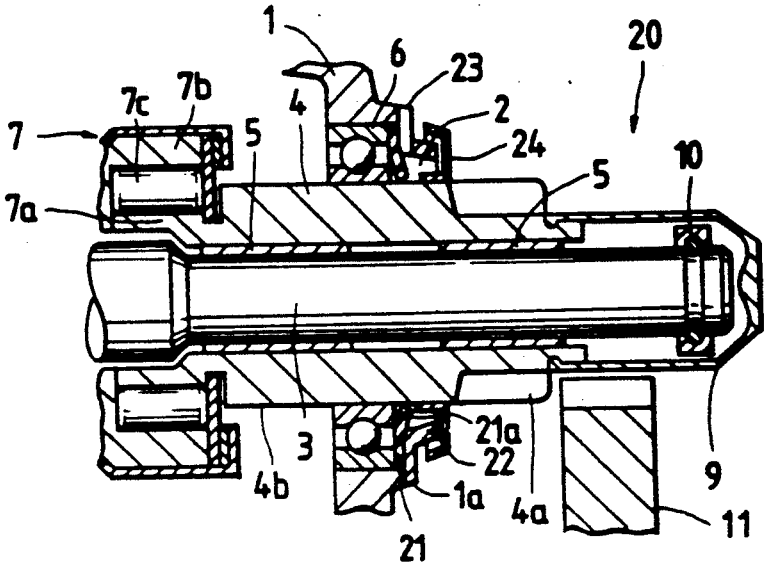
FIG. 1 shows in partial cross section an embodiment of the present invention.
Figure 6:
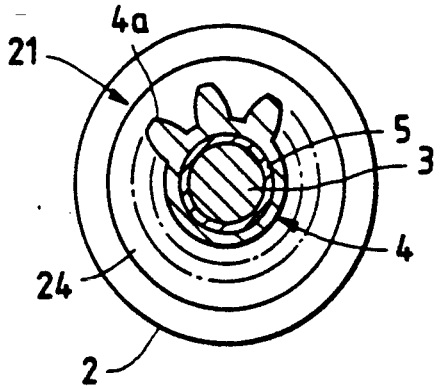
FIG. 6 is a cross section taken along a line VI—VI in FIG. 5.
Figure 7:
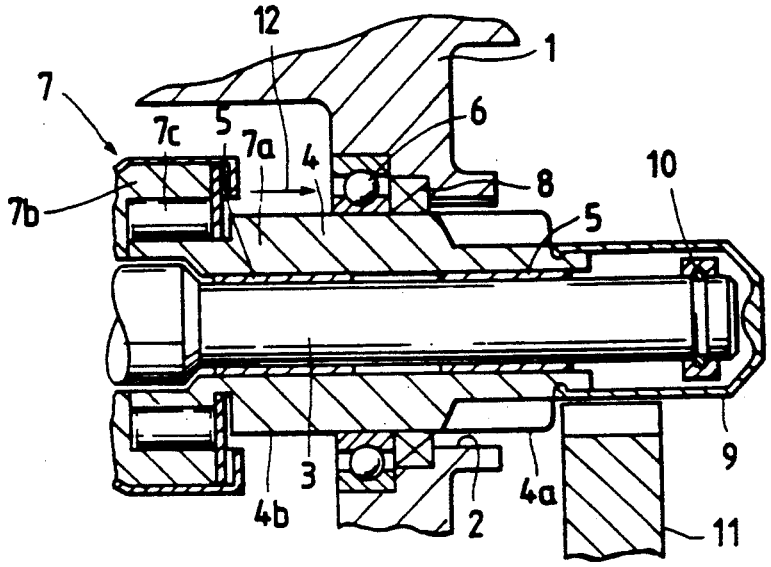
FIGS. 7 to 9 show a conventional starter motor structure.
Figure 8:
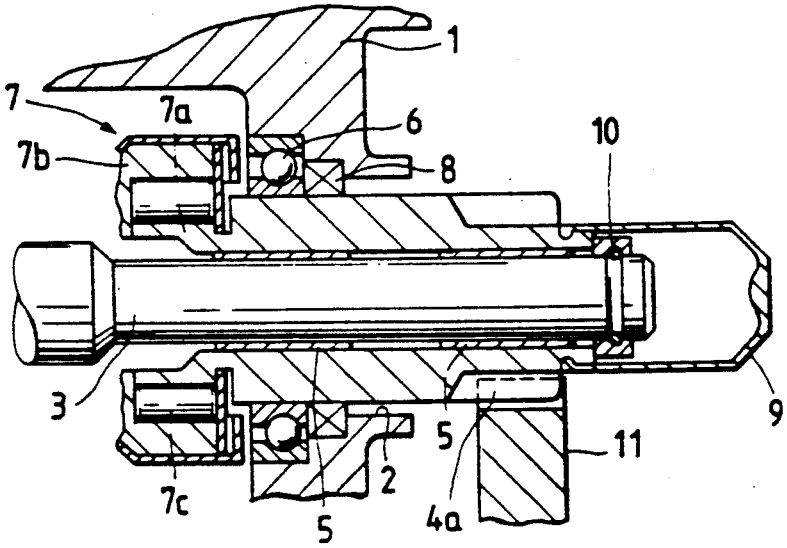
Figure 9:
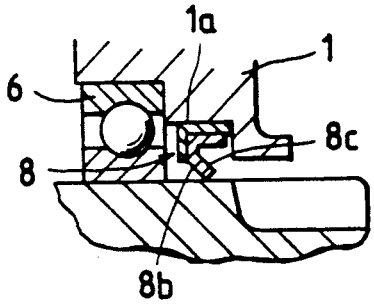

FIG. 1 shows a main portion of a starter motor 20 according to an embodiment of the present invention. In FIG. 1, the same reference numerals as those used in FIGS. 7 to 9 show the same or corresponding portions, respectively, as in FIGS. 2 to 6.

The starter motor 20 has a front frame portion 1 having an opening 2 through which a pinion slider 4 passes. A bearing 6 is pressure fitted in an annular recess formed coaxially with the opening 2 on an inside of the front frame 1. In pressure-fitting the bearing 6 in the recess, an oil seal 21 in the form of a ring is inserted into the recess and then the bearing 6 is pressure-fitted so that the oil seal 21 is fitted therebetween.

An inner peripheral edge of the oil seal 21 is slightly bent axially outwardly to form a lip portion 21*a* which slide-contacts with a slidable support surface 4*b* of the pinion silder 4.

The opening 2 has an annular protrusion 22 extending axially from a peripheral edge thereof. Although, in FIG. 1, the annular protrusion 22 is shown as an integral portion of the front frame 1, it may be possible to provide this protrusion by fitting a flanged cylinder to the frame 1.

In an outer wall portion 1*a* of the front frame 1 corresponding to a base portion of the protrusion 22, a drain hole 23 is formed which extends along the oil seal 21. An annular metal holder 24 having a 90° rotated U shape cross section is fixed by such means as pressure fitting onto the slidable support surface 4*b* of the pinion slider 4 at such position that a top end portion of the protrusion 22 enters into a valley of the U shaped holder 24 when the pinion slider 4 is in a rest position, as shown in FIG. 1.

Assuming that the starter motor 20 constructed as above is mounted on an engine with the pinion slider 4 facing up toward the ring gear 11, the opening 2 of the front frame 1 through which the pinion slider 4 passes is completely covered by the holder 24. Therefore and it is possible to prevent water, dust from entering into the front frame 1. Although water may enter into the opening 2 when the starter motor 20 operates in which the pinion slider 4 protrudes from the front frame 1 so that the holder 24 is separated from the protrusion 22 and the pinion 4*a* thereof meshes with a ring gear 11, the lip portion 21*a* of the oil seal 21, which is in resilient contact with the slidable support surface 4*b* of the pinion slider 4, prevents water from entering into the front frame 1 and water blocked by the lip 21*a* is discharged through the drain hole 23.

Of course, the oil seal 21 may be unnecessary if water immigration into the starter motor 20 occurs only when the pinion slider 4 is in its rest position during a vehicle is used, since the holder 24 completely prevents water immigration in such a state.

Figure 2:
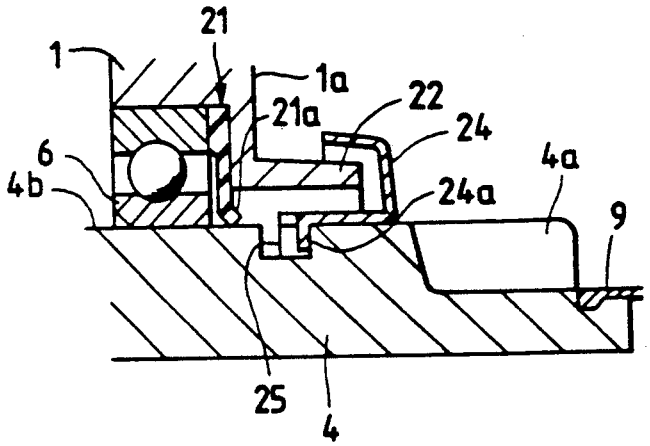
FIG. 2 shows another embodiment of the resent invention.

FIG. 2 shows another embodiment of a metal holder which has means for preventing a drop out of the holder after pressure fitted onto the pinion slider 4. In FIG. 2, the holder 24 has an engage piece 24*a* formed by bending a portion of its wall to be pressure fitted to the pinion slider 4. The engage piece 24*a* is engaged with an annular groove 25 formed in the slidable support surface 4*b* of the pinion slider 4 to hold the holder 24 in that position.

The holder 24 may be fitted on the pinion slider 4 by pressure-inserting the holder 24 onto the pinion slider.4, pushing the pinion slider 4 forward slightly, bending the portion of the holder wall to be used as the engage piece 24*a* into the groove 25 and then returning the pinion slider 4 to the rest position. When the bent portion is so strong that the holder 24 can be secured to the pinion slider 4 by only the engagement between the groove 25 and the engage piece 24*a*, the holder 24 may be fitted by a means other than pressure-fitting.

Figure 3:
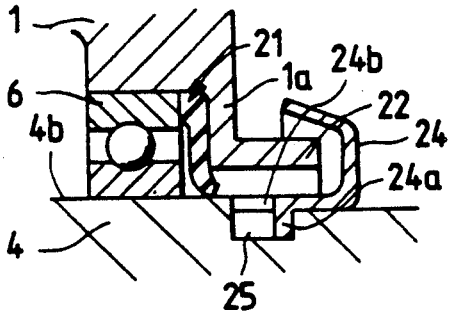
FIG. 3 shows a further embodiment of the present invention.

FIG. 3 shows another embodiment of the pinion slider which provides, together with the holder 24 shown in FIG. 2, a means for positioning the holder on the pinion slider such that a uniform distance is provided between the holder and the annular protrusion 22. In FIG. 3, a pinion slider 4 has an annular groove 25 in a position to which the holder 24 is to be fitted and a diameter of the pinion slider 4 which is rearward from the groove 25 is made larger than that of the other portion. With this structure of the pinion slider 4, a rear end 24*b* of the holder 24 contacts with a step portion formed by the difference in diameter of the pinion slider 4 to position the holder 24 exactly, so that the distance between the annular protrusion 22 protruding from the periphery of the opening 2 of the front frame 1 and the holder 24 is kept constant.

Figure 4:
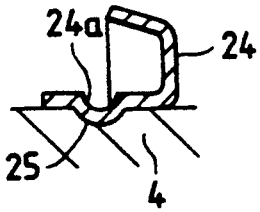
FIG. 4 shows another embodiment of the present invention.

FIG. 4 shows another embodiment of the holder. An annular metal holder 24 has a generally U shape cross section and its wall to be fitted on the pinion slider 4 is slightly longer than the opposite wall and has an annular inward protrusion 24*a*. A pinion slider 4 is formed at a position in which the holder 24 is to be fitted with annular groove 25 having a corresponding cross section to the annular inward protrusion 24*c* of the holder 24. The holder 24, pressure inserted onto the pinion slider 4, is held in place by an engagement of its protrusion 24*a* with the groove 25 of the slider 4.

Figure 5:
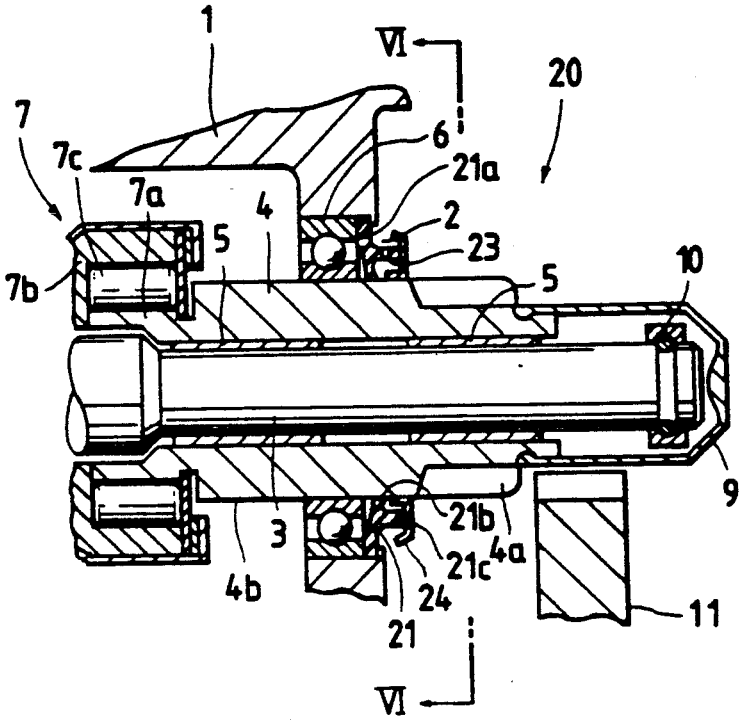
FIG. 5 shows another embodiment of the present invention.

FIG. 5 shows another embodiment of the present invention. In FIG. 5, an annular oil seal 21 of a resilient material has a generally T shape cross section. The lateral bar portion of this T shaped oil seal 21 corresponds to the oil seal 21 shown in FIG. 1, with one end 21*a* of the lateral bar of the T shape being supported between a bearing 6 and a front frame portion 1, the other end 21*b* of the lateral bar being in resilient contact with a slidable support surface 4*b* of a pinion slider 4 and the vertical bar 21*c* of the T corresponds to the annular protrusion 22 shown in FIG. 1 which enters into a holder 24 having substantially the same configuration as that shown in FIG. 1 when the pinion slider 4 is in the rest position. At least one drain hole 23 is formed in the vertical bar 21*c* of the oil seal 21. The oil seal 21 may be formed by molding such material.

The vertical bar 21*c* prevents water from entering into the front frame 1 when the pinion slider 4 is in the rest position. The lateral bar portions 21*a* and 21*b* prevent water from entering into the front frame 1 and the drain hole formed in the vertical bar discharges water when the pinion slider is moved forwardly. FIG. 6 is a side view taken at a line VI—VI in FIG. 5.

What is claimed is:

1. An engine starter motor comprising a front frame portion of a frame in which a d.c. motor is mounted, an opening formed in said front frame portion, a pinion slider having a front portion supported by an output rotary shaft of said motor slidably and formed at a front end with a pinion and a rear portion forming a slidable support surface supported by a bearing provided in said front frame portion, said pinion slider being moved through said opening of said front frame, an annular protrusion protruding forwardly from a periphery of said opening, an oil seal fixedly supported at an outer periphery thereof by a peripheral portion of said opening and an inner periphery thereof in resilient contact with said slidable support surface, and an annular metal holder fitted on said slidable support surface such that said holder covers a front end portion of said annular protrusion when said pinion slider is in a rest position.

2. The engine starter motor claimed in claim 1, wherein said metal holder has a generally 90° rotated U shape cross section and is fitted on said slidable support surface with an inner wall thereof, and said front end portion of said annular protrusion is received within a valley of the U shape cross section of said holder when said pinion slider is in its rest position.

3. The engine starter motor claimed in claim 2, wherein at least one drain hole is formed in said annular protrusion.

4. The engine starter motor claimed in claim 2 or 3, wherein said pinion slider is formed with an annular groove in a position thereof to which said holder is fitted, and wherein said inner wall of said holder has an annular rear edge, a portion of said rear edge being bent inwardly to engage with said groove.

5. The engine starter motor claimed in claim 4, wherein said pinion slider has an enlarged diameter portion rearwardly of said groove to form a step portion, the remaining portion of said rear edge being in contact with said step portion.

6. The engine starter motor claimed in claim 2 or 3, wherein said pinion slider is formed with an annular groove in a position thereof to which said holder is fitted and wherein said inner wall of said holder is formed with an inward protrusion, said inward protrusion being fitted in said annular groove.

7. An engine starter motor comprising a front frame portion of a frame in which a d.c. motor is mounted, an opening formed in said front frame portion, a pinion slider having a front portion supported by an output rotary shaft of said motor slidably and formed at a front end with a pinion and a rear portion forming a slidable support surface supported by a bearing provided in said front frame portion, said pinion slider being moved through said opening of said front frame, an annular oil seal having a generally T shape cross section, one end of a lateral bar portion of said T cross sectioned oil seal being fixedly supported by a peripheral portion of said opening, the other end of said lateral bar portion of said T cross sectioned oil seal being in resilient contact with said slidable support surface, a vertical bar portion of said T cross sectioned oil seal extending in parallel to said slidable support surface, and an annular metal holder fitted on said slidable support surface such that said holder covers a front end portion of said vertical bar portion of said oil seal when said pinion slider is in a rest position.

8. The engine starter motor claimed in claim 7, wherein said metal holder has a generally 90° rotated U shape cross section and fitted on said slidable support surface with an inner wall thereof and said front end portion of said vertical bar portion of said oil seal is received within a valley of the U shape cross section of said holder when said pinion slider is in its rest position.

9. The engine starter motor claimed in claim 8, wherein at least one drain hole is formed in said vertical bar portion of said oil seal.

10. The engine starter motor claimed in claim 8 or 9, wherein said pinion slider is formed with an annular groove in a position thereof to which said holder is fitted and wherein said inner wall of said holder has an annular rear edge, a portion of said rear edge being bent inwardly to engage with said groove.

11. The engine starter motor claimed in claim 10, wherein said pinion slider has an enlarged diameter portion rearwardly of said groove to form a step portion, the remaining portion of said rear edge being in contact with said step portion.

12. The engine starter motor claimed in claim 8 or 9, wherein said pinion slider is formed with an annular groove in a position thereof to which said holder is fitted and wherein said inner wall of said holder is formed with an inward protrusion, said inward protrusion being fitted in said annular groove.

* * * * *